US012492528B2

(12) United States Patent
Stoops et al.

(10) Patent No.: US 12,492,528 B2
(45) Date of Patent: Dec. 9, 2025

(54) HYDRAULIC SYSTEMS FOR GRADING MACHINES

(71) Applicant: Caterpillar Inc., Peoria, IL (US)

(72) Inventors: Ernest E. Stoops, Mt. Zion, IL (US); Nathaniel K. Harshman, Sullivan, IL (US); Jonathan M. Bloot, Tucson, AZ (US)

(73) Assignee: Caterpillar Inc., Peoria, IL (US)

( * ) Notice: Subject to any disclaimer, the term of this patent is extended or adjusted under 35 U.S.C. 154(b) by 1081 days.

(21) Appl. No.: 17/509,978

(22) Filed: Oct. 25, 2021

(65) Prior Publication Data

US 2023/0130171 A1 Apr. 27, 2023

(51) Int. Cl.

| | |
|---|---|
| ***E02F 3/84*** | (2006.01) |
| ***E02F 3/76*** | (2006.01) |
| ***E02F 9/22*** | (2006.01) |

(52) U.S. Cl.

CPC ..... *E02F 3/844* (2013.01); *E02F 3/7668* (2013.01); *E02F 9/2232* (2013.01); *E02F 9/2267* (2013.01)

(58) Field of Classification Search

CPC ..... E02F 3/844; E02F 3/7668; E02F 9/2232; E02F 9/2267; E02F 9/2278

See application file for complete search history.

(56) References Cited

U.S. PATENT DOCUMENTS

| | | | | |
|---|---|---|---|---|
| 7,874,377 | B1 | 1/2011 | Graeve | |
| 9,540,787 | B2 * | 1/2017 | West | E02F 3/7668 |
| 9,644,341 | B2 | 5/2017 | Yoshimura | |
| 10,107,363 | B2 | 10/2018 | Fliearman | |
| 10,745,885 | B2 | 8/2020 | Stoops | |
| 10,753,065 | B2 | 8/2020 | Ono | |
| 2012/0163949 | A1 * | 6/2012 | Okano | E02F 9/2296 91/437 |
| 2014/0251648 | A1 * | 9/2014 | Staade | E02F 3/7668 701/50 |
| 2019/0136875 | A1 * | 5/2019 | Lacher | E02F 9/02 |

FOREIGN PATENT DOCUMENTS

| | | | | |
|---|---|---|---|---|
| DE | 102018132105 | A1 * | 6/2019 | A01B 71/00 |
| WO | 2013058951 | A1 | 4/2013 | |

OTHER PUBLICATIONS

Hank Ayers, Understanding Counterbalance Valves, May 29, 2025, Power & Motion (Year: 2018).*

(Continued)

*Primary Examiner* — Joseph M Rocca
*Assistant Examiner* — Ashley A Kaercher

(57) ABSTRACT

A hydraulic system for operating a circle drive gear of a grading machine includes a pump configured to output pressurized fluid, a directional control valve fluidly coupled to the pump, a bidirectional hydraulic motor located downstream of the directional control valve and fluidly coupled to the directional control valve via hydraulic lines. The hydraulic motor has an output shaft that is configured to be rotationally driven by pressurized fluid output by the pump. Dual counterbalance valves may be disposed within the hydraulic circuit of the directional control valve and hydraulic motor such that any gearbox driven by the hydraulic motor is protected from external opposing forces. Accordingly, motion in the circle drive system is hydraulically locked at the beginning and release of a circle rotation command with the help of fluid pressure in the hydraulic lines.

20 Claims, 6 Drawing Sheets

(56) References Cited

OTHER PUBLICATIONS

Darren Magner Sauer-Danfoss Ames, Valves Add Function to Form, Mar. 12, 2025, Power & Motion (Year: 2008).*
German office Action for German Patent Appln. No. 10 2022 128 038.1, mailed Jul. 6, 2023 (11 pgs).

* cited by examiner

HYDRAULIC SYSTEMS FOR GRADING MACHINES

TECHNICAL FIELD

The present disclosure relates generally to grading machines, and more particularly, to hydraulic systems for motor graders.

BACKGROUND

Grading machines, such as motor graders, are typically used to cut, spread, or level materials that form a ground surface. To perform such earth sculpting tasks, grading machines include a work implement, also referred to as a blade or moldboard. The work implement may move relatively small quantities of earth from side to side, in comparison to a bulldozer or other machine that moves larger quantities of earth. Grading machines are frequently used to form a variety of final earth arrangements, which often require the work implement to be positioned in different positions and/or orientations depending on the sculpting task and/or the material being sculpted. The different work implement positions may include a blade cutting angle.

Grading machines often utilize hydraulic systems to provide functionality and control to various aspects of the machines. For example, some grading machines may utilize hydraulic brake systems, work implement systems, and/or steering systems.

A circle drive may control a position of a circle coupled to the work implement, and thus may adjust the blade cutting angle, for example. Different work implement positions may require different amounts of torque in order to adjust the work implement, especially when the work implement is engaged with material. At the beginning and/or release of a command to control the circle drive, the work implement and/or grading machine may encounter large ground forces which could back drive the motion of the circle. Further, rotating the circle and work implement while the work implement is under an excessive load can lead to slippage in the circle drive, excessive heat generation, and wear of any clutch and/or other gear train components. In some cases, during operation of the grading machine, the work implement (e.g., blade, moldboard) may impact with a heavy and/or immovable object, for example, a rock that is at least partially embedded within and protruding from the earth. The work implement may consequently transmit the forces encountered during such impacts into a driving arrangement of the machine, for example, an output shaft of a hydraulic motor that is configured to rotationally drive a circle drive gear of the grading machine.

Given the speed of the machine and its momentum when travelling on the ground surface, these forces could cause failure of one or more components associated with the driving arrangement of the machine. Hence, it would be advantageous to provide a system that mitigates a susceptibility of components in the driving arrangement from being exposed to such forces when the work implement and/or grading machine encounters resistance (e.g., imposed by the ground, heavy and/or immovable objects) in its path of travel.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Figure 1:
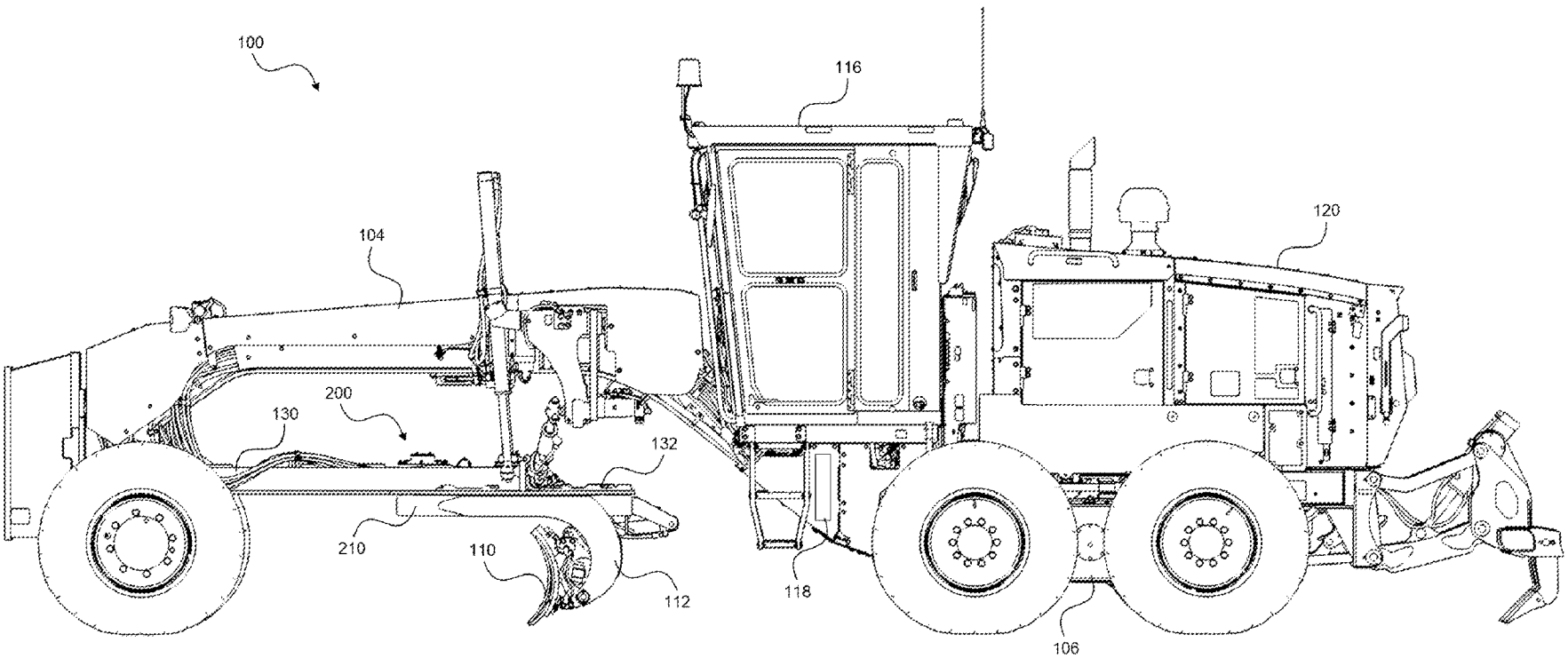
FIG. 1 is a drawing of a side view of a grading machine having a circle drive system for controlling a work implement, in accordance with some embodiments of the present disclosure.

FIG. 1 shows a grading machine 100 with a circle drive system 200. In some embodiments, the grading machine 100 may be a motor grader. The grading machine 100 may include a front frame 104 and a rear frame 106 supported by wheels. An operator may steer the front frame 104 relative to the rear frame 106 about a pivot point from an operator cab 116 disposed on the front frame 104, for example. The operator cab 116 may be configured to house a steering wheel, levers, joysticks, push buttons, and/or other types of user interfaces for controlling various systems of the grading machine 100.

In some embodiments, a controller 118 may be in communication with one or more features of grading machine 100. The controller 118 may receive inputs from and send outputs to, for example, user interfaces in the operator cab 116 and/or an interface remote from the grading machine 100. For example, the grading machine 100 may include electrohydraulic and/or hydro mechanical hydraulic systems, and the controller 118 may control electrical switches and/or valves to operate hydraulic cylinders, motors, actuators, and/or electrical elements. The controller 118 may include one or more controllers each associated with one or more components or systems of the grading machine 100. For example, the controller 118 may be in communication with a pump and/or directional control valves, as described in further detail herein.

The grading machine 100 may include a prime mover 120 (e.g., engine, motor) supported on the rear frame 106, for example. The prime mover 120 may supply driving power for driven components of the grading machine 100. Further, the prime mover 120 may be coupled to a pump or generator for providing hydraulic, pneumatic, or electrical power to the grading machine 100.

The grading machine 100 may include a work implement 110. In some embodiments, the work implement 110 may be a blade and/or a moldboard for helping grade soil. The work implement 110 may be used to cut, spread, level, and/or otherwise sculpt earth or other material traversed by the grading machine 100. The work implement 110 may be mounted on a linkage assembly that allows the work implement 110 to be moved to a variety of different positions and orientations relative to the front frame 104.

Figure 2:
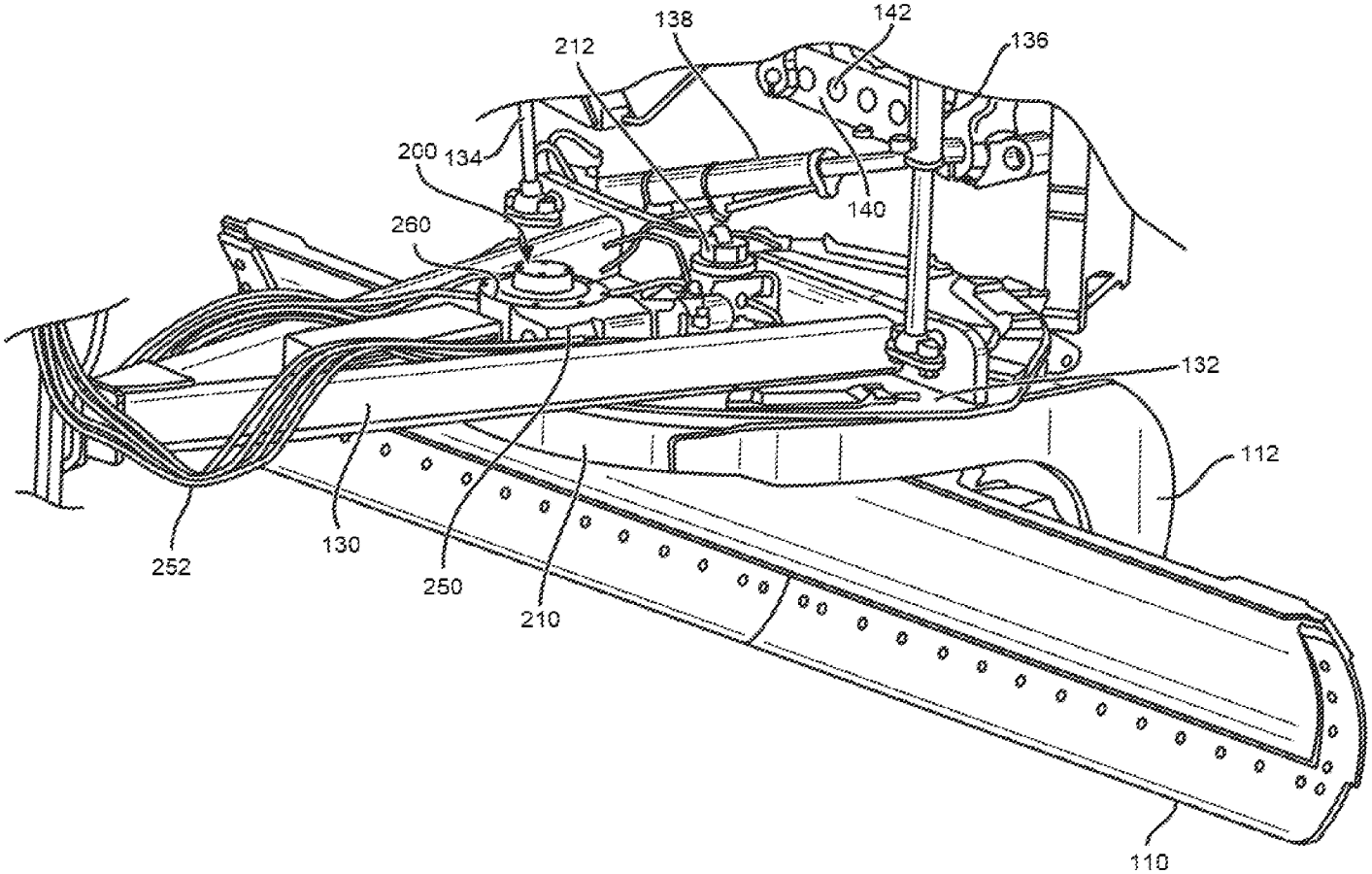
FIG. 2 is a drawing of the circle drive system within the grading machine of FIG. 1, in accordance with some embodiments of the present disclosure.

The grading machine 100 may include a drawbar 130 mounted to the front frame 104 via a ball and socket arrangement, for example. As shown in FIGS. 1-2, the drawbar 130 may be coupled to a large, flat yoke plate 132. The position of the drawbar 130 may be controlled by hydraulic cylinders, including, for example, a right lift cylinder 134, a left lift cylinder 136, a centershift cylinder 138, and a linkbar 140. A height (e.g., blade height) of the work implement 110 with respect to the surface being traversed below the grading machine 100 may be primarily controlled and/or adjusted with the right lift cylinder 134 and/or the left lift cylinder 136. The right lift cylinder 134 and the left lift cylinder 136 may be controlled independently and, thus, may be used to tilt the work implement 110. Based on the positions of the right lift cylinder 134 and the left lift cylinder 136, the work implement 110 may be tilted relative to the traversed material, thus the right lift cylinder 134 and the left lift cylinder 136 may control tilt of the work implement 110. The right lift cylinder 134 and the left lift cylinder 136 may also be used (e.g., simultaneously extended/retracted) to control the height of the work implement 110 relative to the grading machine 100 to control depth of the cut into the ground surface or a height of the work implement 110 above the ground surface. For example, for an aggressive cut or sculpting procedure, the right lift cylinder 134 and the left lift cylinder 136 may be extended such that the work implement 110 is extended away from the grading machine 100 to a lower depth. In some embodiments, if the grading machine 100 is performing a light sculpting procedure, is traversing a ground surface between sculpting procedures, and/or it is otherwise desirable for the work implement 110 to not contact the ground surface, the right lift cylinder 134 and the left lift cylinder 136 may be retracted such that the drawbar 130 and the work implement 110 are lifted up toward the grading machine 100.

The centershift cylinder 138 and the linkbar 140 may be used to shift a lateral position of the drawbar 130, and any components mounted to the drawbar 130, relative to the front frame 104 (e.g., drawbar centershift). The centershift cylinder 138 may include one end coupled to the drawbar 130 and another end pivotably coupled to the linkbar 140. In some embodiments, the linkbar 140 may include a plurality of position holes 142 for selectively positioning the linkbar 140 to the left or right to allow for further shifting of the drawbar 130 to a left or right side of the grading machine 100 by the centershift cylinder 138.

FIG. 2 shows the circle drive system 200 of the grading machine 100 of FIG. 1. In some embodiments, the circle drive system 200 may include a gearing arrangement (not shown) to engage with and rotate a circle gear or circle 210 that adjusts the orientation of the work implement 110. The circle 210 may be positioned under the yoke plate 132 or otherwise directly and/or indirectly coupled to the drawbar 130. The circle 210 may include a plurality of teeth (not shown) that extend along an entire inner face of the circle 210. In some embodiments, the circle 210 may be coupled to the work implement 110 via a support arm 112.

The circle 210 may be rotated by the circle drive system 200. In some embodiments, the circle drive system 200 may include a motor 250 and a gear box 260. The motor 250 may be a hydraulic motor (e.g., bidirectional) coupled to one or more hydraulic lines 252. In some embodiments, the motor 250 may be in communication with the controller 118. The motor 250 may be any motor that includes or is coupled to a rotational output shaft (e.g., gerotor type hydraulic motor, gear motor, vane motor, axial plunger motor, radial piston motor). In some embodiments, although not shown, the circle drive system 200 may include more than one motor and associated gear box (e.g., front circle drive system and rear circle drive system).

The rotational output shaft of the motor 250 may drive the gear box 260 and, in turn, rotate the circle 210. Although not shown, the gear box 260 may include an output shaft that engages with teeth on the inner portion of the circle 210 to rotate the circle 210. The gear box 260 may be directly coupled to the motor 250 or may be coupled to the motor 250 via a gear coupling (not shown). In some embodiments, the gear box 260 may be laterally adjacent to the motor 250. Moreover, the gear box 260 may include any gear arrangement (e.g., one or more epicyclic or planetary gear assemblies, spur gears, worm gears) to drive the rotation of the circle 210. In some embodiments, the gear box 260 may include one or more epicyclic or planetary gear assemblies (not shown), and a gear coupling may couple the motor 250 to the gear box 260 and the internal planetary gear assembly.

In some embodiments, the gear box 260 may also include one or more slip clutches and/or brakes, which may help to protect the motor 250 and gear arrangement in situations where the work implement 110 and/or the circle 210 encounters a heavy or severe external load while traversing the ground surface. In some embodiments, the gear box 260 may include a combining interface, which can help connect gear couplings to the other portions of the gear box 260. For example, combining interface may include an exterior with threaded holes or other coupling mechanisms to couple exterior components of the gear coupling to other portions of the gear box 260. The gear box 260 may include a housing to enclose the gearing, and a support plate mounted on the yoke plate 132 to couple the circle drive system 200 to the linkage assembly.

The rotation of the circle 210 by the circle drive system 200 may adjust a circle angle and pivot the work implement 110 relative to the drawbar 130. In some embodiments, a cutting angle may be defined as the angle of the work implement 110 relative to the front frame 104, and the cutting angle may be controlled by a combination of the position of the circle 210 and the position of the drawbar 130. Based on the effect of the circle drive system 200, the circle 210 and the work implement 110 may be rotated clockwise or counterclockwise relative to the front frame 104. In some embodiments, the circle 210 and the work implement 110 may be rotated up to about 75° clockwise and/or counterclockwise. In other embodiments, the circle 210 and the work implement 110 may be rotated 360° clockwise and/or counterclockwise. A 0° cutting angle may be created when the work implement 110 is arranged at a right angle to the front frame 104.

In some embodiments, a circle angle sensor 212 (e.g., rotary sensor, inertial measurement unit) may be positioned on the circle 210 to measure an angular rotation of the circle 210, and thus an angle of the work implement 110. For example, the circle angle sensor 212 may be mounted in a centered position on the circle 210. As another example, the circle angle sensor 212 may be mounted in an off-centered position on the circle 210, and the circle angle sensor 212 and/or other internal components of the grading machine 100 may be used to calculate the position of the circle 210 and the work implement 110 based on a compensation or correction to account for the off-centered position of the circle angle sensor 212. The circle angle sensor 212 may also help to prevent the work implement 110 from being positioned at such an angle where the work implement 110 may contact or otherwise interfere with the wheels. For example, the circle angle sensor 212 may be in communication with the controller 118, and may warn the operator and/or limit rotation of the circle 210 if a selected position would position the work implement 110 at an angle where the work implement 110 may contact wheels and/or other portions of the grading machine 100.

The grading machine 100 may include a plurality of hydraulic lines 252 to control hydraulic cylinders and/or hydraulic motors. The grading machine 100 may include a hydraulic pump (e.g., pump 330). The hydraulic pump may supply high pressure hydraulic fluid through one or more hydraulic lines 252 to one or more hydraulic cylinders and/or hydraulic motors (e.g., motor 250, bidirectional hydraulic motor 350). In some embodiments, a low pilot pressure may be provided by a hydraulic pressure reducing valve, which can receive the high pressure hydraulic fluid and supply low pilot pressure to each hydraulic cylinder and/or hydraulic motor. Additionally, each hydraulic cylinder and/or motor may include an electrical solenoid and one or more hydraulic valves. The solenoid may receive one or more signals from the controller 118 to control and position/rotation each hydraulic cylinder/motor by configuring the flow of hydraulic fluid through the valves.

The delivery of the hydraulic fluid may be controlled by the controller 118. In some embodiments, the controller 118 may control the delivery of hydraulic fluid through the hydraulic lines 252 to the motor 250 to control the position and/or orientation of the circle 210 and the work implement 110.

In some embodiments, an operator may send a command (e.g., using a joystick) to a control valve (e.g., directional control valve 310, directional control valve 410, directional control valve 412) via the controller 118 to rotate the circle 210 counterclockwise, for example. In response to the command from the controller 118, the control valve may direct the flow of hydraulic fluid from the hydraulic pump to the motor 250 via the hydraulic lines 252. In response to the pressurized flow of hydraulic fluid from the control valve through the hydraulic lines 252, the output shaft of the motor 250 may be forced to rotate, thereby driving the output of the gear box 260 to engage with the inner teeth of the circle 210 and rotating the circle 210 counterclockwise according to the operator's command.

FIGS. 3-6 show various hydraulic circuits for a grading machine circle drive system.

Figure 3:
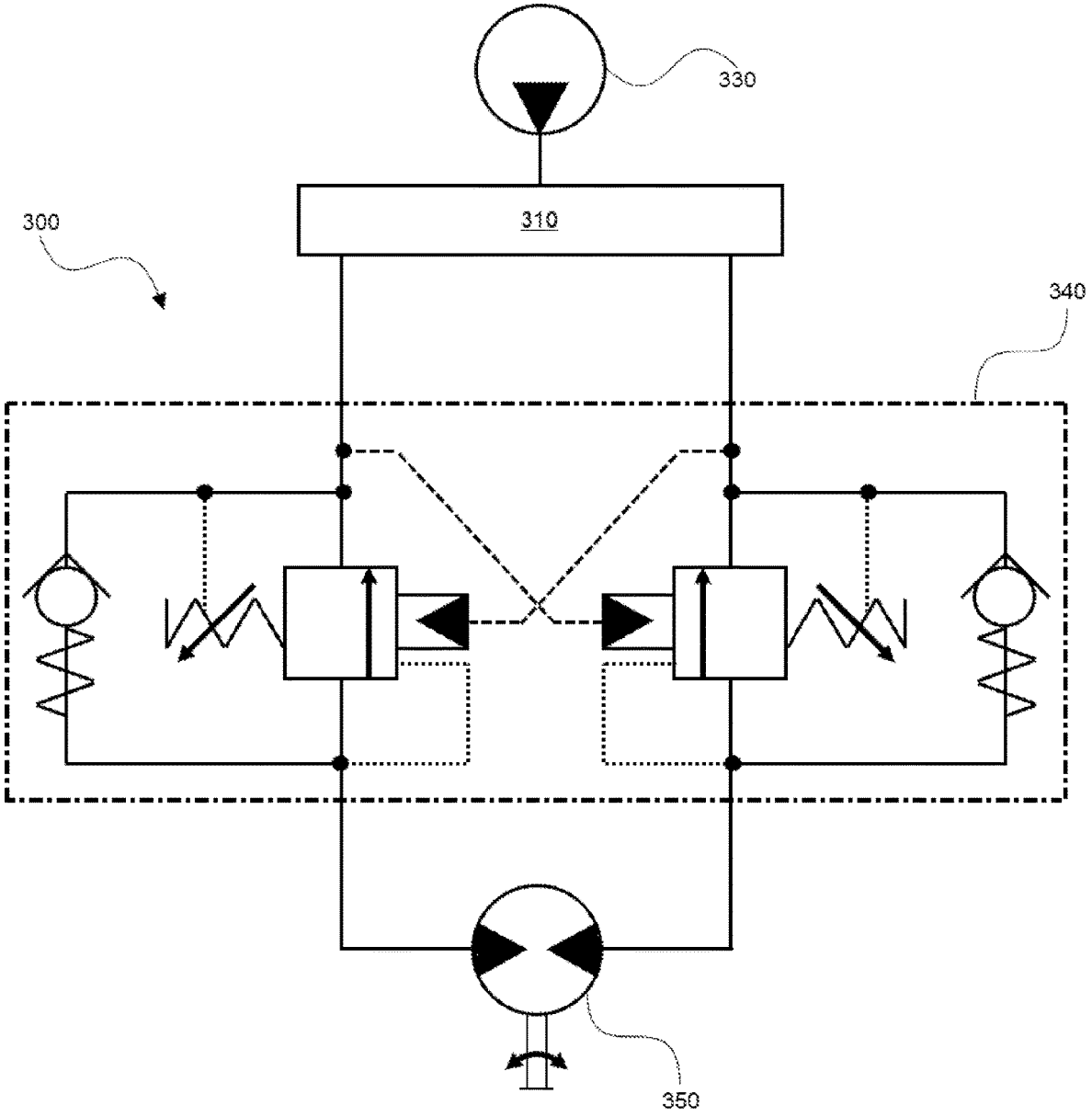
FIG. 3 is a schematic diagram of a hydraulic circuit for a grading machine circle drive system with a hydraulic motor, in accordance with some embodiments of the present disclosure.

As seen in FIG. 3, in some embodiments, a hydraulic system 300 for controlling the work implement 110 of the grading machine 100 may include a pump 330. The pump 330 may be configured to output pressurized fluid (e.g., hydraulic oil) therefrom, thus providing a flow of pressurized fluid within the hydraulic system 300. The pump 330 may be any component which functionally interacts with the pressurized fluid to convert mechanical energy to hydraulic energy, and/or vice versa. As such, the term "pump" as used in connection with the pump 330 is meant to include and be defined as any one or more of a hydraulic pump, a hydraulic motor, as well as a combination hydraulic pump/motor. The pump 330 may be any fluid delivery pump, such as a piston pump, a gear pump, a gerotor pump, a screw pump, a centrifugal pump, etc., based on the application requirements. As a non-limiting example, the pump 330 could be a gear pump or gerotor including two meshing gears with one of the gears being an internal gear and the other gear being an external gear mounted within and eccentrically relative to the internal gear. As shown in FIG. 3, the pump 330 may be a fixed displacement pump. However, in other embodiments, the pump 330 may be a variable displacement pump.

Additionally, in some embodiments, the pump 330 may be electronically and/or controllably connected to the controller 118, such that the operation and actuation of the pump 330 can be controlled in response to one or more signals generated by the controller 118 and electronically transmitted to, and received by, the pump 330.

Further, as shown in FIG. 3, the hydraulic system 300 may include a directional control valve 310 fluidly coupled to the pump 330 via a supply line. The directional control valve 310 may be any type of control valve, such as, for example, mechanically operated, hydraulically operated, electro-hydraulic, pneumatic, or the like. In some embodiments, the directional control valve 310 may be a hydraulically operated valve. In other embodiments, the directional control valve 310 may be an electromechanically operated valve or any other type or configuration suitable for performing functions consistent with the present disclosure.

The directional control valve 310 may be in communication with the controller 118 for receiving control signals (e.g., circle rotation commands). In some embodiments, the directional control valve 310 may include a proportional valve element that may be spring biased and solenoid actuated (e.g., via a control signal from the controller 118) to move the valve element among a plurality of positions between a substantially flow blocking position (or substantially closed position) and a fully opened position. The amount of pressurized fluid directed from the pump 330 may be a function of the position of the directional control valve 310 and, thus, the corresponding amount of flow area thereof. As such, the directional control valve 310 may be configured to regulate fluid pressure in the hydraulic lines 252 associated with the pump 330. In some embodiments, the directional control valve 310 may further include first and second pilot lines upstream and downstream of the directional control valve 310, respectively, for communicating reference load pressures to the directional control valve 310.

As shown in FIG. 3, the hydraulic system 300 may also include a bidirectional hydraulic motor 350 (e.g., with a fixed-displacement volume). The bidirectional hydraulic motor 350 may be located downstream of the directional control valve 310. Moreover, the bidirectional hydraulic motor 350 may be fluidly coupled to the directional control valve 310 via a first delivery line and a second delivery line (e.g., hydraulic lines 252). As illustrated in FIG. 3, the bidirectional hydraulic motor 350 may have an output shaft configured to be rotationally driven by pressurized fluid output by the pump 330 via the first and second delivery lines.

The directional control valve 310 may be configured to start, stop, or change the flow of the pressurized fluid and, thus, control the rotation of the bidirectional hydraulic motor 350. For example, the directional control valve 310 may be a solenoid operated, variable position, four-way, three-position valve movable between a first working position, a second position, and a neutral position. In the first working position, a first port of the bidirectional hydraulic motor 350 may be in fluid communication with the pump 330 and a second port of the bidirectional hydraulic motor 350 may be in fluid communication with a tank. In the second working position, the first port may be in fluid communication with the tank, and the second port may be in fluid communication with the pump 330. In the neutral position, the flow from the pump 330 to the bidirectional hydraulic motor 350 may be blocked. As another example, the directional control valve 310 may include an independent metering valve (IMV) system that includes plurality of independently-operated valves.

The output shaft of the bidirectional hydraulic motor 350 may include, be coupled to (e.g., via a gear coupling), and/or otherwise engage with a gear box (e.g., gear box 260) or other gearing arrangement for rotating the circle 210 of the grading machine 100. For example, the gear box 260 may include one or more components of a planetary gear assembly, and the hydraulic system 300 may include a bevel gear, gear coupling, or any other appropriate gear assembly to engage with and/or drive one or more components of the planetary gear assembly.

In some embodiments, the output shaft of the bidirectional hydraulic motor 350 may include or be affixed to a sun gear of the planetary gear assembly. The sun gear may engage with a plurality of planet gears, which in turn engage with a ring gear. Each of the planet gears may be coupled via a carrier. The ring gear may be coupled to or include a drive shaft that includes a circle engaging gear. Rotation of the ring gear, via planet gears, drives the rotation of the drive shaft and the circle engaging gear. The circle engaging gear may engage with teeth on the internal face of the circle 210 such that rotation of the circle engaging gear rotates the circle 210, and thus controls an angle of the work implement 110. Many other planetary gearing configurations in which the rotationally driven output shaft of the bidirectional hydraulic motor 350 provides the input for the planetary gear assembly are contemplated.

In other embodiments, the hydraulic system 300 may include a worm (e.g., worm screw) affixed to a free end of the output shaft of the bidirectional hydraulic motor 350, and a pinion (e.g., worm gear) may be directly coupled to one or more interior portions of the gear box 260 and may be laterally disposed to the worm. For example, a shaft may extend from the pinion and be coupled to the sun gear. Alternatively, the pinion may be directly or indirectly coupled to a carrier of the sun gear. Accordingly, in either aspect, rotation of the pinion may rotate the sun gear of the planetary gear assembly. In some embodiments, a first gear may be located at a first end of the pinion and may be disposed in selective engagement with the worm with the help of a clutch. Moreover, a second end of the pinion may be configured to bear a second gear that may be adapted to operatively drive the circle 210.

As shown in FIG. 3, the hydraulic system 300 may further include dual counterbalance valves 340 located between the directional control valve 310 and the bidirectional hydraulic motor 350. Accordingly, mechanical springs within the dual counterbalance valves 340 may set a threshold that the hydraulic fluid pressure must exceed before the hydraulic system 300 allows any other hydraulic fluid flow. Advantageously, the hydraulic fluid pressure threshold established by the dual counterbalance valves 340 may save the bidirectional hydraulic motor 350 from being back-driven due to torque applied on the work implement 110 or other opposing forces that may reverse the intended rotation of the circle 210. In this manner, the dual counterbalance valves 340 may hydraulically lock flow across the bidirectional hydraulic motor 350 to be in the commanded rotational direction at the beginning or release of a circle rotate command from the operator when pressure in the hydraulic circuit is below the threshold. Moreover, when the directional control valve 310 is in a neutral position, the dual counterbalance valves 340 may hydraulically lock flow across the bidirectional hydraulic motor 350 in either direction. Further, the dual counterbalance valves 340 may allow for a more modulated or smoother control over the rotation of the circle 210 since the hydraulic fluid pressure threshold regulates the dynamic opening (and thus outflow or circuit pressure relief) of one counterbalance valve based on the continual pressure build-up across the cross-port line as fluid freely flows through the check valve line of the other (closed) counterbalance valve into one side of the bidirectional hydraulic motor 350.

In some embodiments, the dual counterbalance valves 340 may be configured such that the hydraulic fluid pressure threshold or valve setting (e.g., spring stiffness or winding) may be varied depending on the size of the grading machine 100 and/or the application. For example, the valve setting range of the dual counterbalance valves 340 may be from about 25,000 kPa (3,625 psi) to about 35,000 kPa (5,077 psi). In some embodiments, the actual valve setting may be about 27,500 kPa (3,989 psi). In this way, varying the valve setting may vary the hydraulic fluid pressure threshold for the hydraulic system. In some embodiments, the hydraulic fluid pressure threshold may correspond to a threshold load or torque on the motor 250, one or more slip clutches within the gear box 260, and/or the connection between the motor 250 or the gear box 260 and the circle 210. The threshold load may correspond to (e.g., be equal to or less than) a maximum torque that a component of the circle drive system 200 can withstand. The hydraulic fluid pressure threshold may be manually or automatically adjustable based on the type of grading machine 100, the type and/or temperature of material being traversed and/or graded, or other factors. For example, a user interface may allow the operator to select a severe grading application to be implemented by controller 118 by inputting the material being graded, the severity of the grading application (e.g., hard rocky material or frozen ground, soft gravel or snow), and/or the threshold load on work implement 110. In response to the operator's inputs, the user interface may display a recommended hydraulic fluid pressure threshold and/or range. Additionally or alternatively, the grading machine 100 may automatically set the hydraulic fluid pressure threshold based on the operator's inputs. Alternatively, the dual counterbalance valve assembly may not easily allow variation to the hydraulic fluid pressure threshold via the mechanical spring to prevent tampering after being set.

In some embodiments, the dual counterbalance valves 340 may be housed within a dual counterbalance valve assembly. Further, one or more components of the hydraulic system 300 may be combined into one housing or separated into multiple housings.

Figure 4:
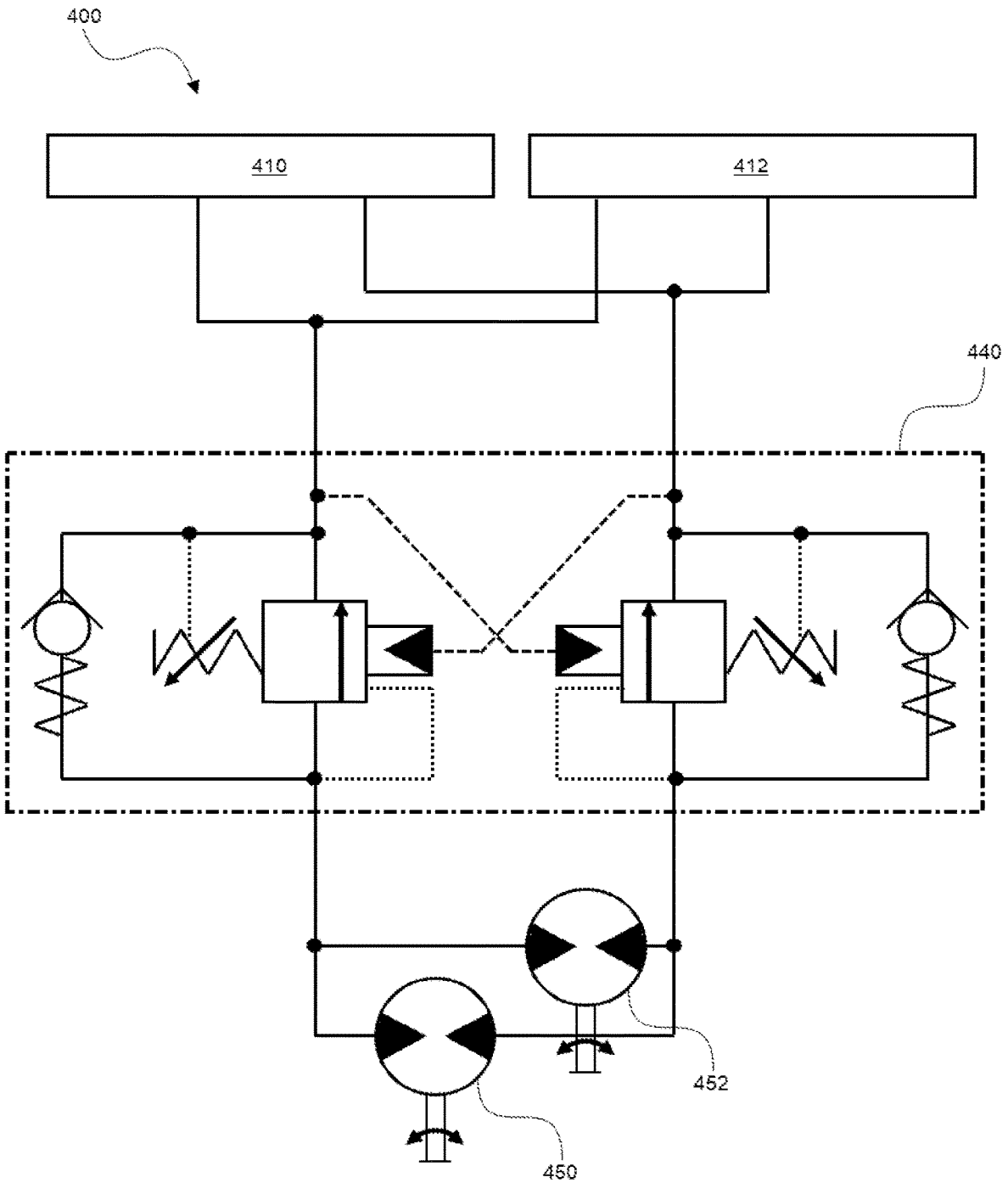
FIG. 4 is a schematic diagram of a hydraulic circuit for a grading machine circle drive system with two hydraulic motors, in accordance with some embodiments of the present disclosure.

As shown in FIG. 4, in some embodiments, a hydraulic system 400 for controlling the work implement 110 of the grading machine 100 may include two directional control valves 410, 412, a dual counterbalance valve assembly 440, and two bidirectional hydraulic motors 450, 452. The hydraulic system 400 shown in FIG. 4 may operate similarly to the hydraulic system 300 of FIG. 3, with the addition of a bidirectional hydraulic motor 452 working in parallel with the bidirectional hydraulic motor 450 with an additional directional control valve 412 to direct hydraulic fluid through a first delivery line and a second delivery line (e.g., hydraulic lines 252), alongside the directional control valve 410. Although two bidirectional hydraulic motors 450, 452 are shown in the illustrated embodiment of FIG. 4, it may be noted that such a tandem configuration of hydraulic motors is exemplary in nature and hence, non-limiting of this disclosure. In alternative embodiments, the circle drive system 200 may include fewer or more hydraulic motors than that disclosed herein depending on specific requirements of an application. For example, the circle drive system 200 may include one hydraulic motor in lieu of two hydraulic motors disclosed herein. To that end, the above disclosure is explained in conjunction with one of the hydraulic motors. However, it may be noted that similar explanation is applicable for either of the bidirectional hydraulic motors 450, 452 shown in FIG. 4.

Figure 5:
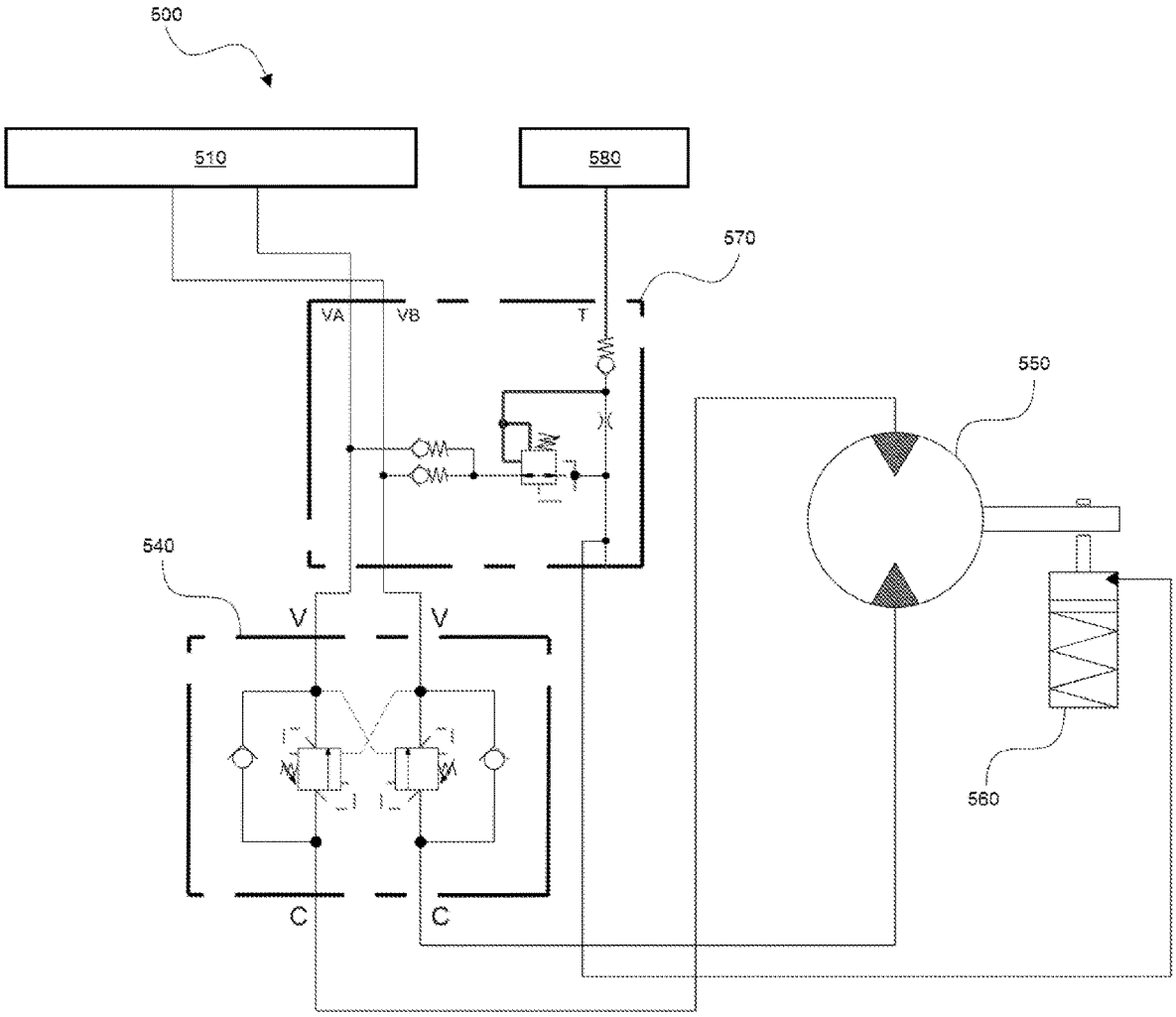
FIG. 5 is a schematic diagram of a hydraulic circuit for a grading machine circle drive system with a braked hydraulic motor, in accordance with some embodiments of the present disclosure.

As shown in FIG. 5, in some embodiments, a hydraulic system 500 for controlling the work implement 110 of the grading machine 100 may include a directional control valve 510, a dual counterbalance valve assembly 540, and a bidirectional hydraulic motor 550. The hydraulic system 500 shown in FIG. 5 may operate similarly to the hydraulic system 300 of FIG. 3.

Figure 6:
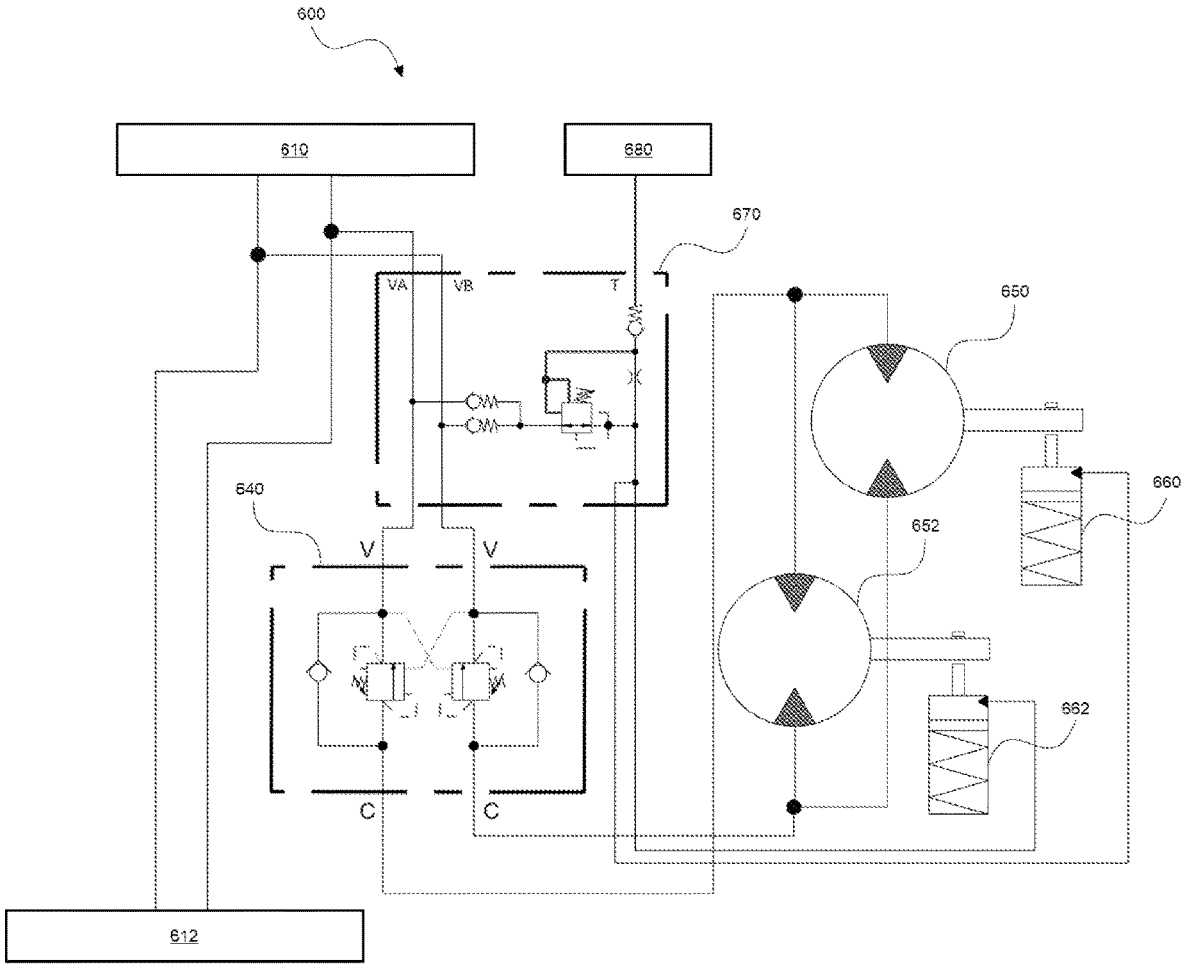
FIG. 6 is a schematic diagram of a hydraulic circuit for a grading machine circle drive system with two braked hydraulic motors, in accordance with some embodiments of the present disclosure.

As shown in FIG. 6, in some embodiments, a hydraulic system 600 for controlling the work implement 110 of the grading machine 100 may include two directional control valves 610, 612, a dual counterbalance valve assembly 640, and two bidirectional hydraulic motors 650, 652. The hydraulic system 600 shown in FIG. 6 may operate similarly to the hydraulic system 400 of FIG. 4.

As shown in FIGS. 5-6, a brake (e.g., brake 560, 660, 662) is disposed on the output shaft of the hydraulic motor (e.g., bidirectional hydraulic motor 550, bidirectional hydraulic motors 650, 652) and engages with the output shaft with the help of a spring force for reducing a rotational speed of the output shaft in a brake engage state. The brake operatively disengages from the output shaft in a brake release state with the help of fluid pressure in at least one of a first delivery line and a second delivery line (e.g., hydraulic lines 252). The hydraulic systems 500, 600 may further include a pressure reducing valve assembly 570, 670 located downstream of and fluidly coupled to first and second delivery lines of the directional control valves 510, 610, 612. The pressure reducing valve assembly 570, 670 may include one-way check valves upstream of the inlet of the pressure reducing valve. The pressure reducing valve assembly 570, 670 may be located upstream of a tank 580, 680. The pressure reducing valve assembly 570, 670 may be fluidly coupled to the one or more brakes 560, 660, 662 via one or more brake control lines. In some embodiments, a return line of the pressure reducing valve assembly 570, 670 may include an orifice sized to maintain a pressure in the brake control line within a predetermined difference range with respect to the hydraulic fluid pressure in the return line downstream of the orifice.

INDUSTRIAL APPLICABILITY

The various aspects of the hydraulic systems of the present disclosure may be used in any grading/sculpting machine or other machine having one or more bidirectional hydraulic motors (e.g., motor 250). to assist an operator in positioning and orienting the work implement 110 and the circle 210. Additionally, the disclosed method of using a dual counterbalance valve assembly (e.g., dual counterbalance valves 340) within the hydraulic circuit may help prevent damage to one or more of the work implement 110, the circle 210, the motor 250, and the gear box 260 during the rotation and positioning of the work implement 110 and the circle 210.

The grading machine 100 may receive a circle rotation command to control the rotation of the circle 210 during a grading operation. For example, an operator may input a circle rotation command via a joystick or via a user interface, and the command may be transmitted to the controller 118. Alternatively, the circle rotation command may be automatically initiated or received by the controller 118 through an automated grading procedure, for example, when the grading machine 100 is moving forward and/or executing a programmed procedure.

It is noted that grading machine 100 may include any number of circle drive systems 200. The circle drive system(s) 200 may be coupled to various portions of the circle 210, and each circle drive system 200 and its components may be different sizes. Furthermore, the controller 118 may be coupled to the one or more circle drive system(s) 200. Including more than one circle drive system 200 may reduce the overall size of each circle drive system and/or the overall height. For example, the grading machine 100 may include two circle drive systems and may deliver as much or greater torque to the circle 210 with each circle drive motor being smaller than the circle drive motor (e.g., motor 250) of a grading machine 100 with a single circle drive motor. Additionally or alternatively, each gear box may be smaller or include fewer planetary gear assemblies and deliver an equal or larger torque on the circle 210 than a single circle drive system. In one aspect, each gear box may include a limit on the amount of torque that may be delivered through the gear box and/or the gear reduction of the gear box. In this aspect, including more than one circle drive system and the corresponding more than one gear box may allow for a greater torque to be delivered and/or a greater gear reduction to take place when controlling the positioning of the circle 210 and the work implement 110. Moreover, the position of the one or more circle drive systems 200 may allow for additional or larger support elements to be coupled to one or more of the drawbar 130, the circle 210, and the work implement 110 relative to the front frame 104.

Using one or more planetary gear assemblies within the circle drive system 200 may help to deliver a greater amount of torque to the teeth on the internal face of the circle 210 or other components of the work implement 110 and the circle 210. Such an increase in torque may be beneficial when adjusting a position of the work implement 110 and the circle 210 when the work implement 110 is engaged with material on a ground surface or is otherwise under the effect of external forces.

When using one or more planetary gear assemblies within the circle drive system 200 (e.g., instead of a worm and pinion), inclusion of dual counterbalance valves in the hydraulic system (e.g., hydraulic system 300) may aid in preventing the motor 250 from being driven in reverse due to external forces acting on the work implement 110. The grading machine 100 may include multiple hydraulic circuits and one or more dual counterbalance valve assemblies in order to help prevent damage to the circle drive system(s) 200 and grading machine 100. Wear or damage to the work implement 110, the circle 210, the motor 250, and the gear box 260, or another component of grading machine 100 may necessitate expensive or time-consuming repairs or otherwise affect the performance of the grading machine 100.

Using dual counterbalance valves 340 in the hydraulic circuit of a circle drive system sets a mechanical pressure threshold to help prevent damage to various components of the grading machine 100, for example, prevent slippage in the circle drive system 200, excessive heat generation, wear of a clutch or other gear train components, etc. This mechanical threshold may thus be implemented without using sensors or requiring any additional monitoring or processing to be performed by the controller 118. Advantageously, this dual counterbalance valve solution is not susceptible to software or other computing errors and may not incur any lag time in use. Further, the dual counterbalance valves 340 may lock motion of the circle 210 without having to actively physically actuate a component (e.g., brake) or disconnect any gearing connection between the circle drive motor (e.g., motor 250) and the gear box 260. In this way, the dual counterbalance valve assembly (e.g., dual counterbalance valves 340) may exist as a passive component within the hydraulic circuit.

It will be apparent to those skilled in the art that various modifications and variations can be made to the disclosed machine without departing from the scope of the disclosure. Other embodiments of the machine will be apparent to those skilled in the art from consideration of the specification and practice of the hydraulic systems for grading machines disclosed herein. It is intended that the specification and examples be considered as exemplary only, with a true scope of the disclosure being indicated by the following claims and their equivalents.

LIST OF ELEMENTS

Title: Hydraulic Systems for Grading Machines
File: 21-0457

100 grading machine
104 front frame
106 rear frame
110 work implement
112 support arm
116 operator cab
118 controller
120 prime mover
130 drawbar
132 yoke plate
134 right lift cylinder
136 left lift cylinder
138 centershift cylinder
140 linkbar
142 position holes
200 circle drive system
210 circle
212 circle angle sensor
250 motor
252 hydraulic lines
260 gear box
300 hydraulic system
310 directional control valve
330 pump
340 dual counterbalance valves
350 bidirectional hydraulic motor
400 hydraulic system
410 directional control valve
412 directional control valve
440 dual counterbalance valves
450 bidirectional hydraulic motor
452 bidirectional hydraulic motor
500 hydraulic system
510 directional control valve
540 dual counterbalance valves
550 bidirectional hydraulic motor
560 brake
570 pressure reducing valve assembly
580 tank
600 hydraulic system
610 directional control valve
612 directional control valve
640 dual counterbalance valves
650 bidirectional hydraulic motor
652 bidirectional hydraulic motor
660 brake
662 brake
670 pressure reducing valve assembly
680 tank

What is claimed is:

1. A hydraulic system for a grading machine including:
a pump configured to output pressurized fluid therefrom;
a first directional control valve fluidly coupled to the pump via a supply line;
a dual counterbalance valve assembly located downstream of the first directional control valve and fluidly coupled to the first directional control valve via a first delivery line and a second delivery line; and
a first bidirectional hydraulic motor located downstream of the dual counterbalance valve assembly and fluidly coupled to the dual counterbalance valve assembly,
the first bidirectional hydraulic motor having a first output shaft associated therewith,
the first output shaft configured to be rotationally driven by pressurized fluid output by the pump, and
the dual counterbalance valve assembly configured to hydraulically lock flow across the first bidirectional hydraulic motor at a beginning or a release of a circle rotate command when hydraulic fluid pressure in the hydraulic system is below a hydraulic fluid pressure threshold.

2. The hydraulic system of claim 1, further comprising:
a first brake disposed on the first output shaft of the first bidirectional hydraulic motor, the first brake configured to:
engage with the first output shaft using a spring force for reducing a rotational speed of the first output shaft in a brake engage state; and
operatively disengage from the first output shaft in a brake release state using fluid pressure in at least one of the first delivery line and the second delivery line.

3. The hydraulic system of claim 1, further comprising:
a second directional control valve fluidly coupled to the pump and located upstream of and fluidly coupled to the dual counterbalance valve assembly; and
a second bidirectional hydraulic motor located downstream of the dual counterbalance valve assembly and fluidly coupled to the dual counterbalance valve assembly, the second bidirectional hydraulic motor having a second output shaft associated therewith, the second output shaft configured to be rotationally driven by pressurized fluid output by the pump.

4. The hydraulic system of claim 3, further comprising:
a first brake disposed on the first output shaft of the first bidirectional hydraulic motor, the first brake configured to:
engage with the first output shaft using a spring force for reducing a rotational speed of the first output shaft in a brake engage state; and
operatively disengage from the first output shaft in a brake release state using fluid pressure in at least one of the first delivery line and the second delivery line.

5. The hydraulic system of claim 4, further comprising:
a second brake disposed on the second output shaft of the second bidirectional hydraulic motor, the second brake configured to:
engage with the second output shaft using a spring force for reducing a rotational speed of the second output shaft in a brake engage state; and
operatively disengage from the second output shaft in a brake release state using fluid pressure.

6. The hydraulic system of claim 1, wherein the dual counterbalance valve assembly includes a variable pressure spring for adjusting the hydraulic fluid pressure threshold.

7. The hydraulic system of claim 6, wherein the hydraulic fluid pressure threshold is preset and within a range between about 25,000 kPa and about 35,000 kPa.

8. The hydraulic system of claim 7, wherein the hydraulic fluid pressure threshold is preset to about 27,500 kPa.

9. A grading machine comprising:

a work implement;

a circle drive system coupled to the work implement such that rotating the circle drive system adjusts an angle orientation of the work implement;

a pump configured to output pressurized fluid therefrom;

a directional control valve fluidly coupled to the pump via a supply line;

a bidirectional hydraulic motor located downstream of the directional control valve and fluidly coupled to the directional control valve via a first delivery line and a second delivery line, the bidirectional hydraulic motor having an output shaft associated therewith, and the output shaft of the bidirectional hydraulic motor configured to be rotationally driven by pressurized fluid output by the pump for rotating the circle drive system; and a dual counterbalance valve assembly, located between and fluidly coupled to the directional control valve and the bidirectional hydraulic motor, configured to hydraulically lock flow across the bidirectional hydraulic motor at a beginning or a release of a circle rotate command when pressure is below a threshold.

10. The grading machine of claim 9, wherein the circle drive system includes one or more planetary gear assemblies.

11. The grading machine of claim 9, wherein the circle drive system includes a worm gear assembly.

12. The grading machine of claim 9, further comprising:

a brake disposed on the output shaft of the bidirectional hydraulic motor, the brake configured to:

engage with the output shaft using a spring force for reducing a rotational speed of the output shaft in a brake engage state; and operatively disengage from the output shaft in a brake release state using fluid pressure in at least one of the first delivery line and the second delivery line.

13. The grading machine of claim 9, further comprising:

a second directional control valve fluidly coupled to the pump and located upstream of and fluidly coupled to the dual counterbalance valve assembly; and a second bidirectional hydraulic motor located downstream of the dual counterbalance valve assembly and fluidly coupled to the dual counterbalance valve assembly, the second bidirectional hydraulic motor having a second output shaft associated therewith, the second output shaft configured to be rotationally driven by pressurized fluid output by the pump.

14. The grading machine of claim 13, further comprising:

a first brake disposed on the output shaft of the bidirectional hydraulic motor, the first brake configured to:

engage with the output shaft using a spring force for reducing a rotational speed of the output shaft in a brake engage state; and operatively disengage from the output shaft in a brake release state using fluid pressure in at least one of the first delivery line and the second delivery line.

15. The grading machine of claim 14, further comprising:

a second brake disposed on the second output shaft of the second bidirectional hydraulic motor, the second brake configured to:

engage with the second output shaft using a spring force for reducing a rotational speed of the second output shaft in a brake engage state; and operatively disengage from the second output shaft in a brake release state using fluid pressure.

16. A hydraulic system for a grading machine including:

a pump configured to output pressurized fluid therefrom;

a directional control valve fluidly coupled to the pump via a supply line;

a dual counterbalance valve assembly located downstream of the directional control valve and fluidly coupled to the directional control valve via a first delivery line and a second delivery line; and a bidirectional hydraulic motor located downstream of and fluidly coupled to the dual counterbalance valve assembly, the bidirectional hydraulic motor having an output shaft associated therewith configured to be rotationally driven by pressurized fluid output by the pump, and the dual counterbalance valve assembly being configured to hydraulically lock flow across the bidirectional hydraulic motor at a beginning or a release of a circle rotate command when pressure in the hydraulic system is below a threshold.

17. The hydraulic system of claim 16, further comprising:

a second directional control valve fluidly coupled to the pump and located upstream of and fluidly coupled to the dual counterbalance valve assembly; and a second bidirectional hydraulic motor located downstream of the dual counterbalance valve assembly and fluidly coupled to the dual counterbalance valve assembly, the second bidirectional hydraulic motor having a second output shaft associated therewith, the second output shaft configured to be rotationally driven by pressurized fluid output by the pump.

18. The hydraulic system of claim 16, wherein the dual counterbalance valve assembly includes dual counterbalance valves in a cross-port arrangement.

19. The hydraulic system of claim 16, wherein rotation of the output shaft of the bidirectional hydraulic motor is configured to be substantially constant in either direction.

20. The hydraulic system of claim 16, wherein the dual counterbalance valve assembly hydraulically is configured to lock the flow across the bidirectional hydraulic motor against opposing motion.

* * * * *